US010374367B2

(12) United States Patent
Maesoba et al.

(10) Patent No.: US 10,374,367 B2
(45) Date of Patent: Aug. 6, 2019

(54) COMMUNICATION CONNECTOR AND HOUSING WITH A METAL PARTITION WALL BETWEEN WIRES

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Rhushik Matroja, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/753,623

(22) PCT Filed: Aug. 17, 2016

(86) PCT No.: PCT/JP2016/073953
§ 371 (c)(1),
(2) Date: Feb. 20, 2018

(87) PCT Pub. No.: WO2017/030134
PCT Pub. Date: Feb. 23, 2017

(65) Prior Publication Data

US 2018/0287304 A1 Oct. 4, 2018

(30) Foreign Application Priority Data

Aug. 20, 2015 (JP) ..... 2015-162498

(51) Int. Cl.
*H01R 13/6593* (2011.01)
*H01R 13/6473* (2011.01)
(Continued)

(52) U.S. Cl.
CPC ..... *H01R 13/6593* (2013.01); *H01R 13/6473* (2013.01); *H01R 13/6589* (2013.01);
(Continued)

(58) Field of Classification Search
CPC ..... H01R 13/6589; H01R 13/6593; H01R 13/5833; H01R 13/582; H01R 13/5841;
(Continued)

(56) References Cited

U.S. PATENT DOCUMENTS 4,508,414 A * 4/1985 Kusui ..... H01R 13/6592 439/607.47
6,045,389 A * 4/2000 Ferrill ..... H01R 9/031 439/398

(Continued)

FOREIGN PATENT DOCUMENTS

JP 60-98279 7/1995
JP 2008-507110 3/2008

OTHER PUBLICATIONS

International Search Report dated Oct. 18, 2016.

*Primary Examiner* — Tulsidas C Patel
*Assistant Examiner* — Travis S Chambers
(74) *Attorney, Agent, or Firm* — Gerald E. Hespos; Michael J. Porco; Matthew T. Hespos

(57) ABSTRACT

A communication connector (30) includes a plurality of terminals (31) to be connected to a plurality of wires (12 to 18) exposed by removing a coating (20) of a cable (11) in which the plurality of wires (12 to 18) for transmitting communication signals are collectively surrounded by the coating (20), a housing (35) for holding the plurality of terminals (31) arranged side by side in a plurality of stages, and alignment members (40A, 40B) including partition walls (44 to 46) made of metal and to be disposed between adjacent ones of the exposed plurality of wires (12 to 18).

9 Claims, 23 Drawing Sheets

(51) Int. Cl.
*H01R 43/28* (2006.01)
*H01R 13/6589* (2011.01)
*H01R 24/60* (2011.01)
*H01R 13/6599* (2011.01)

(52) U.S. Cl.
CPC ..... *H01R 43/28* (2013.01); *H01R 13/6599* (2013.01); *H01R 24/60* (2013.01)

(58) Field of Classification Search
CPC ..... H01R 13/6585; H01R 13/6461; Y10S 439/942; Y10S 439/901; H04B 2201/709709
USPC ..... 439/607.05, 456, 942, 497, 579, 941
See application file for complete search history.

(56) References Cited

U.S. PATENT DOCUMENTS 6,255,593 B1 * 7/2001 Reede ..... H01R 13/6463 174/110 R
6,328,601 B1 12/2001 Yip et al.
6,336,826 B1 * 1/2002 Kraft ..... H01R 13/6463 439/498
6,506,077 B2 * 1/2003 Nagel ..... H01R 13/6474 439/418
6,580,867 B2 * 6/2003 Galaj ..... G02B 6/4459 174/117 F
6,648,697 B2 * 11/2003 Yang ..... H01R 13/6585 439/701
6,764,342 B2 * 7/2004 Murayama ..... H01R 4/023 439/607.1
7,114,985 B2 * 10/2006 Doorhy ..... H01R 4/2433 439/404
7,147,512 B2 12/2006 Wu
7,604,515 B2 * 10/2009 Siemon ..... H01R 13/6463 439/676
8,011,950 B2 * 9/2011 McGrath ..... H01R 12/594 439/497
9,236,683 B2 * 1/2016 Fransen ..... H01R 4/2445
9,905,978 B2 * 2/2018 Zebhauser ..... H01R 13/6463
2006/0014431 A1 1/2006 Shuey et al.
2013/0343713 A1 12/2013 Hayashishita
2014/0238722 A1 * 8/2014 Hayashishita ..... H01B 13/34 174/115

* cited by examiner

COMMUNICATION CONNECTOR AND HOUSING WITH A METAL PARTITION WALL BETWEEN WIRES

BACKGROUND

Field of the Invention

The invention relates to a communication connector.

Description of the Related Art

Japanese Unexamined Patent Application Publication No. 2008-507110 describes an electrical connector capable of receiving four USB plug connectors. This electrical connector includes a housing, electrical contacts formed of metal pieces bent into an L shape, an outer shield and an inner shield. The electrical contacts are fixed side by side in a lateral direction for each of the USB plug connectors.

The connector may use a cable, in which wires are covered collectively, instead of using metal bars as conductors. In this case, the wires are exposed at an end part of the cable where a coating is removed. Intervals between the wires easily change in this part where the wires are exposed. Thus, impedances of the wires may change at some points and signals may be reflected to reduce communication quality.

The invention was completed on the basis of the above situation and aims to suppress a reduction of communication quality.

SUMMARY

The invention is directed to a communication connector with of terminals to be connected to wires exposed by removing a coating of a cable in which the wires for transmitting communication signals are surrounded collectively by the coating. The connector also has a housing for holding the terminals side by side in stages, and an alignment member including a partition wall made of metal and to be disposed between adjacent wires that are exposed by removing the coating.

According to this configuration, the partition wall made of metal is disposed between the wires in a part where an impedance changes between the wires due to the exposure of the wires caused by removing the coating of the cable. Thus, impedance changes of the wires can be suppressed. The reflection of the signals at impedance change points can be suppressed in this way, and therefore a reduction of communication quality can be suppressed.

If the terminals are arranged side by side in one stage in the housing, the communication connector tends to become longer in an arrangement direction of the terminals. Thus, there is a problem that an arrangement space is more subject to restrictions. On the other hand, the terminals are arranged and held side by side in stages in the housing. Thus, the communication connector has a compact shape and is less subject to arrangement space restrictions.

Plural alignment members may be provided, and one of the alignment members may include a locking portion to be locked to another one of the alignment members. This locking maintains the relative positions of the alignment members. In this way, there will be no lifting of the wires from the alignment members caused by relative displacements of the alignment members.

A tape may be wound around the wires with the wires disposed on an outer surface side of the alignment member. Thus, the wires can be held in position by a simple configuration.

The tape may be a metal tape including a metal layer. Thus, a reduction of communication quality can be suppressed by a shielding function of the metal tape.

The wires may include a low-speed wire and two high-speed wires capable of faster transmission than the low-speed wire. The partition wall may partitions between the two high-speed wires. Signals are easily degraded by being reflected or radiated in wires for transmitting high-speed signals. However, according to this configuration, degradation caused by the reflection or radiation of the signals can be suppressed in such a case.

A communication connector with cable includes the above communication connector and a cable to be connected to the terminals.

According to the present invention, it is possible suppress a reduction of communication quality.

DETAILED DESCRIPTION

First Embodiment

A first embodiment is described with reference to FIGS. 1 to 11.

A communication connector with cable 10 is mounted in a vehicle, such as an electric or hybrid vehicle, and is disposed in a wired communication path, such as between an in-vehicle electrical device (navigation system, ETC, monitor, etc.) in the vehicle and an external device (camera, etc.) or between the in-vehicle electrical devices. In the following description, a left side (Z direction) and a right side of FIG. 2 are referred to as a front and rear concerning a front-rear direction, and a vertical direction and a lateral direction are based on directions of FIG. 3 (X direction extends rightward and Y direction extends up).

(Communication Connector with Cable 10)

Figure 2:
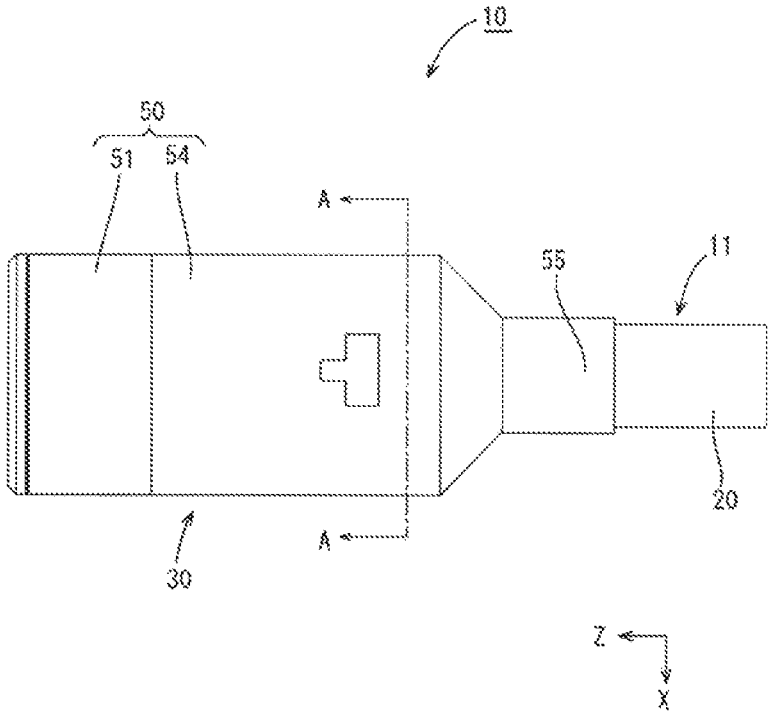
FIG. 2 is a plan view showing the communication connector with cable.
Figure 3:
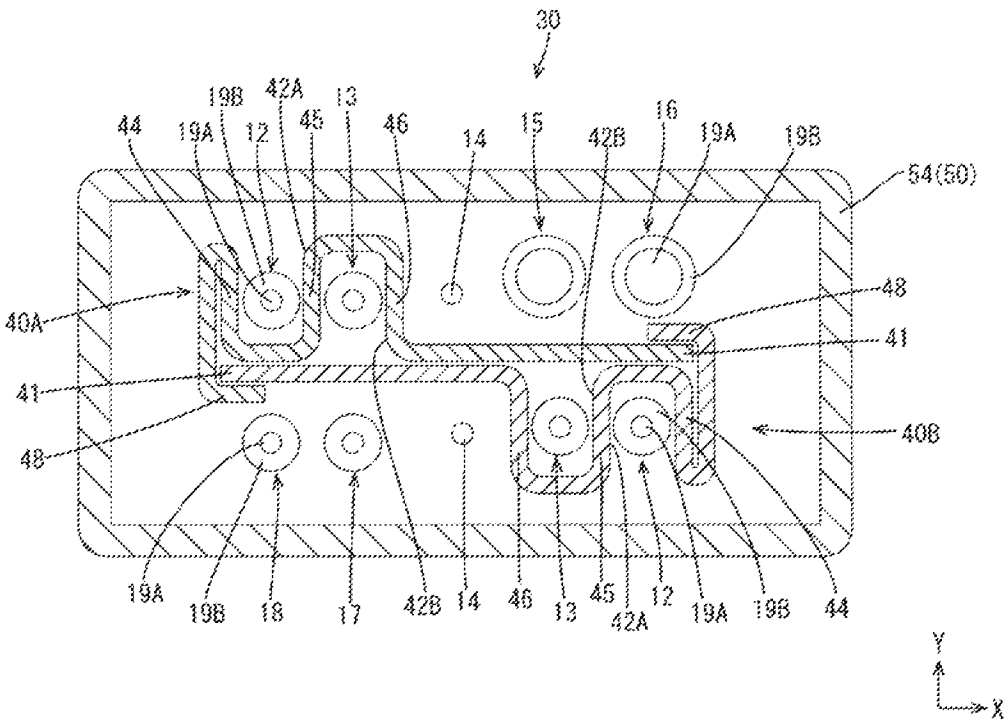
FIG. 3 is a section along A-A of FIG. 2.

The communication connector with cable 10 of this embodiment includes a cable 11 and a communication connector 30 provided on an end part of the cable 11, as shown in FIGS. 2 and 3. The cable 11 is capable of high-speed communication at a speed of 1 GHz or higher and includes wires 12 to 18 for transmitting communication signals and an insulating coating 20 for collectively surrounding the wires 12 to 18. Note that an unillustrated shielding layer formed by braiding thin metal wires collectively surrounds the wires 12 to 18 inside the coating 20, and an unillustrated filling member fills up clearances by packing insulating threads, paper tape or the like inside this shielding layer.

Two pairs of wires 12, 13 (an example of "high-speed wires") shown in FIG. 3 are both wires of high-speed wire pairs (differential pairs with shield and drain wire) having a faster maximum data transmission speed than the wires 17, 18 (an example of "low-speed wires") and, in this embodiment, are of USB (Universal Serial Bus) 3.0 standard and capable of transmission at a speed of, e.g. 5 Gbps. The wires 12, 13 constitute twisted pair cables and are untwisted in a part exposed by removing the coating 20 in this embodiment. However, the twisted pair cables may not be used as the wires 12, 13. The wires 17, 18 are wires of one pair (twisted pair without shield) different in type from the wires 12, 13 and, in this embodiment, are wires of USB 2.0 standard. The wires 14 are drain wires. The wire 16 is one power supply wire connected to a power supply and the wire 15 is one ground wire connected to ground.

Each wire 12 to 18 has a metal conductor 19A covered with an insulating layer 19B made of insulating synthetic resin, and differs in thickness (outer diameter) depending on the type of the wire 12 to 18. The wires 12 to 18 are disposed such that five wires are arranged side by side in the lateral direction in each of upper and lower stages. The insulating layer 19B is stripped at a leading end part of the wire 12 to 18 exposed by removing the coating 20 of the cable 11, thereby exposing the metal conductor 19A to be connected to a terminal 31.

(Communication Connector 30)

Figure 4:
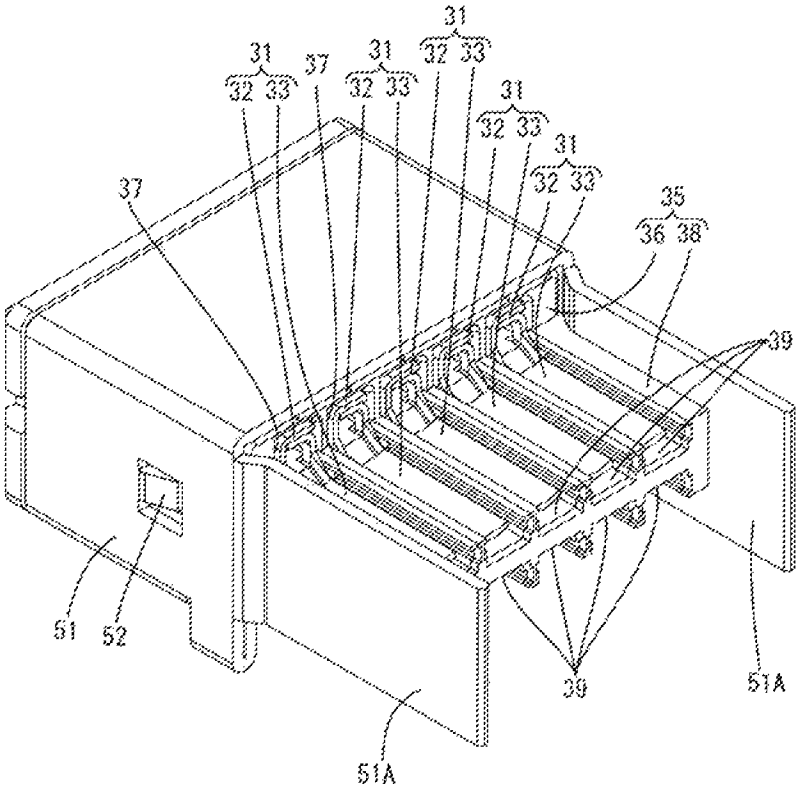
FIG. 4 is a perspective view showing the communication connector in a state where a second shield case is removed.
Figure 5:
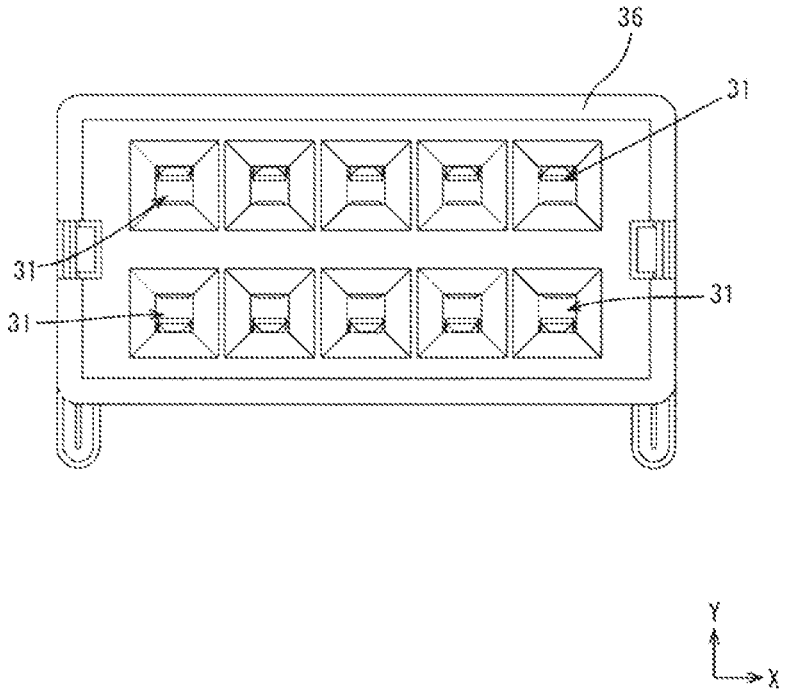
FIG. 5 is a front view showing the communication connector in the state where the second shield case is removed.
Figure 6:
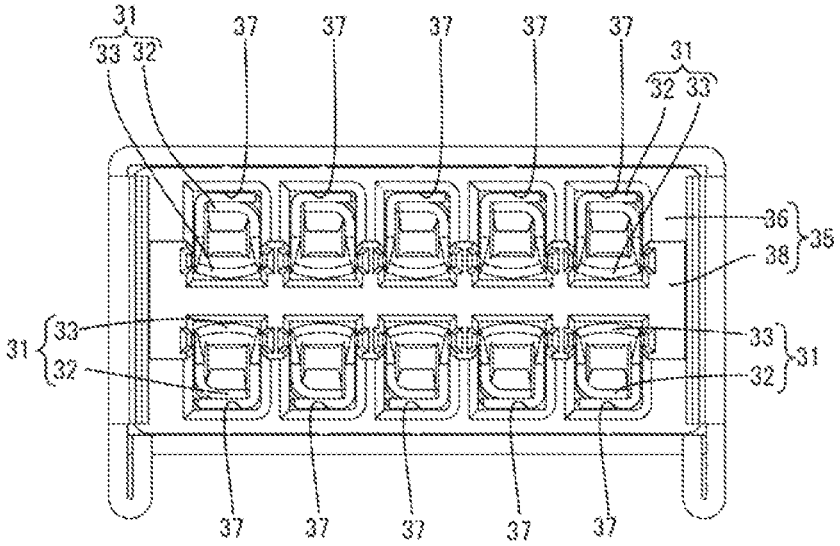
FIG. 6 is a back view showing the communication connector in the state where the second shield case is removed.
Figure 7:
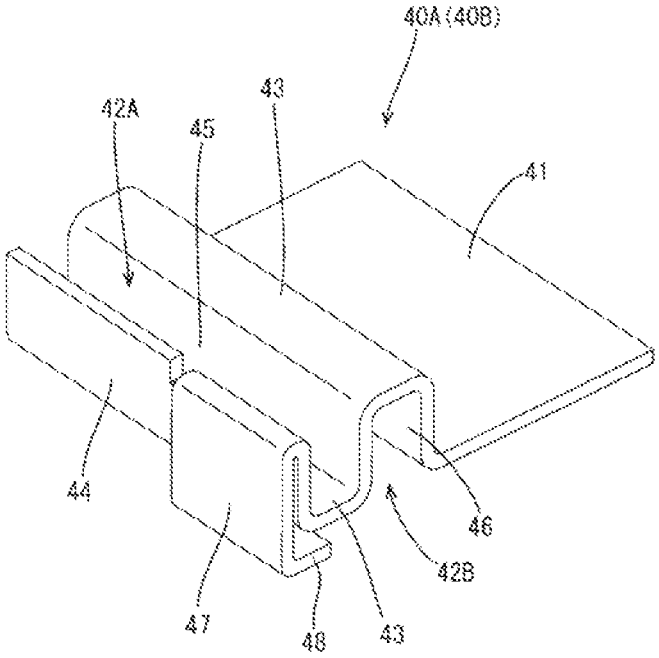
FIG. 7 is a perspective view showing an alignment member.
Figure 8:
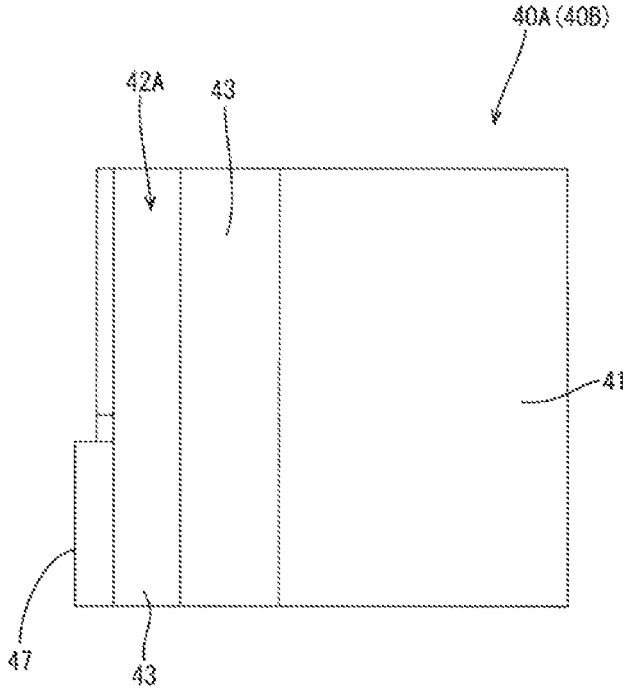
FIG. 8 is a plan view showing the alignment member.
Figure 9:
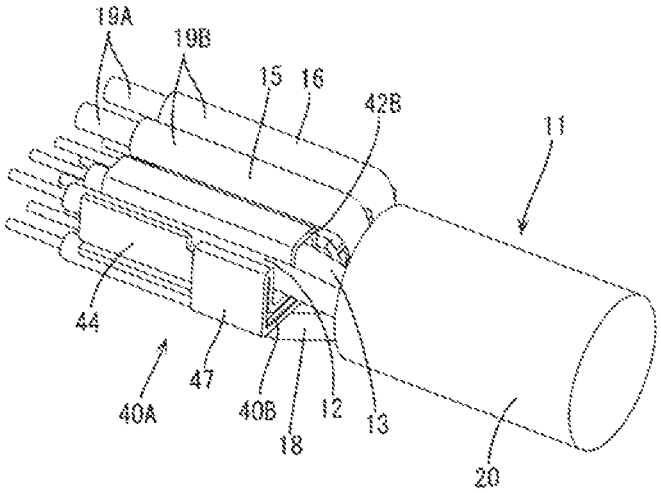
FIG. 9 is a perspective view showing a state where wires are mounted in the alignment members.
Figure 10:
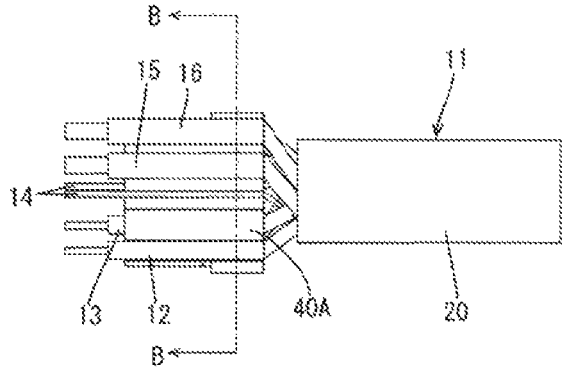
FIG. 10 is a plan view showing a state where the wires are mounted in the alignment members.

As shown in FIGS. 3 and 4, the communication connector 30 includes terminals 31, a housing 35, two alignment members 40A, 40B and a shield case 50.

(Terminal 31)

A front of the terminal 31 is formed into a rectangular tubular terminal connecting portion 32 and a plate-like wire connecting portion 33 to be connected to the metal conductor 19A exposed from the wire 12 to 18 is formed integrally behind the terminal connecting portion 32. The metal conductor 19A of the wire 12 to 18 is connected to the wire connecting portion 33, for example, by soldering or welding. The terminal connecting portion 32 is provided with a resilient contact piece to be connected to a mating male terminal.

(Housing 35)

The housing 35 is made of insulating synthetic resin and includes a body 36 for accommodating the terminal connecting portion 32 of each terminal 31. An extending portion 38 extends rearward from the body 36 and has a smaller vertical thickness than the body 36. The body 36 is in the form of a rectangular parallelepiped and five cavities 37 for accommodating the terminals 31 are arranged side by side at intervals in the lateral direction in each of upper and lower stages. Each cavity 37 has a rectangular cross-section corresponding to the outer peripheral shape of the terminal connecting portion 32 and extends in the front-rear direction according to a length of the terminal connecting portion 32. The terminal connecting portion 32 has movements thereof in the front-rear direction restricted inside the cavity 37.

The plate-like extending portion 38 extends rearward from a vertical middle part of the rear end of the body 36 and includes groove-like placing portions 39 arranged side by side such that the wire connecting portions 33 of the respective terminals 31 can be placed thereon. The plate-like portions 39 are formed side by side in the lateral direction on each of the upper and bottom surfaces of the extending portion 38 in correspondence with the number of the terminals 31.

(Alignment Members 40A, 40B)

The two alignment members 40A, 40B have the same shape, are disposed to be connected behind the extending portion 38 and are formed by stamping and bending a metal plate material such as aluminum, aluminum alloy, copper or copper alloy. Each of the alignment members 40A, 40B includes a flat plate 41 extending in the lateral direction, insertion grooves 42A, 42B into which the wires 12, 13 are inserted, and a locking portion 48 to be locked to the other alignment member 40A, 40B. The insertion grooves 42A, 42B are disposed in opposite orientations via a common partition wall 45 and the wires 12, 13 are inserted in opposite vertical directions.

The insertion groove 42A, 42B includes a groove bottom 43 and partition walls 44 to 46 vertically standing from the groove bottom 43. A folded portion 47 is folded at an end part of the partition wall 44 and extends toward an opposite side, and a tip part of the folded portion 47 is formed into the locking portion 48 by being bent into an L shape. The folded portion 47 and the locking portion 48 are formed behind the partition wall 46.

Figure 11:
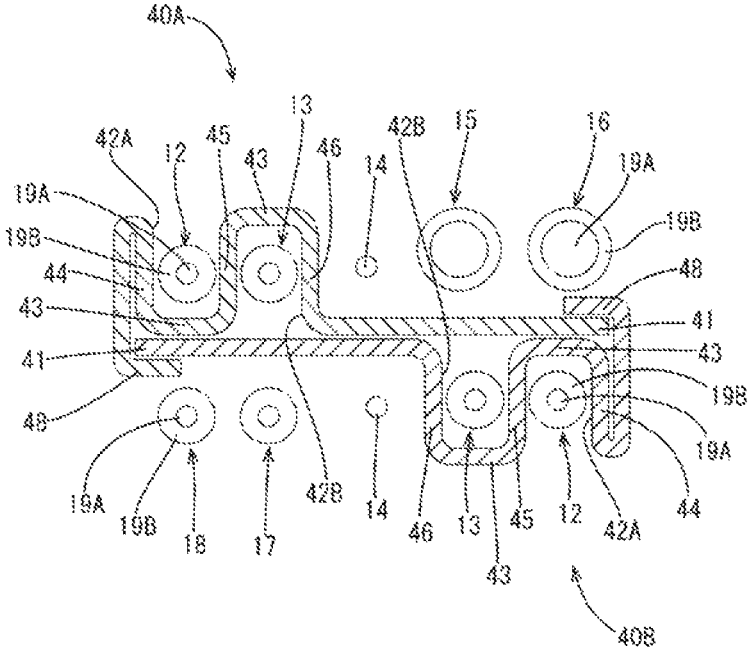
FIG. 11 is a section along B-B of FIG. 10.
Figure 12:
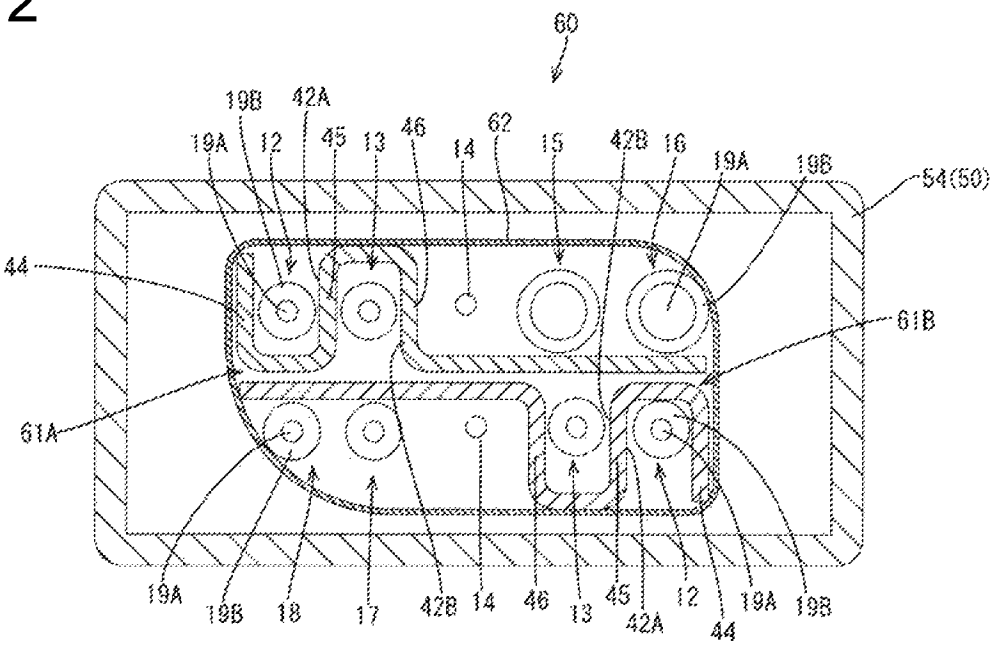
FIG. 12 is a section showing a communication connector with cable of a second embodiment.
Figure 13:
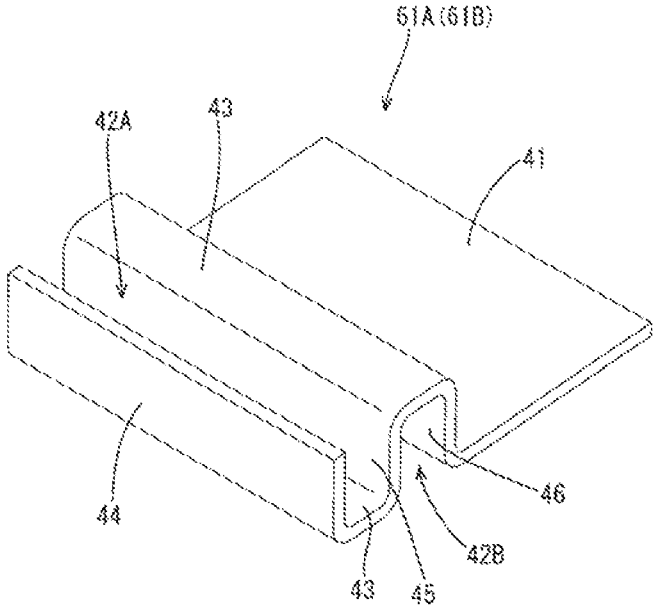
FIG. 13 is a perspective view showing an alignment member.
Figure 14:
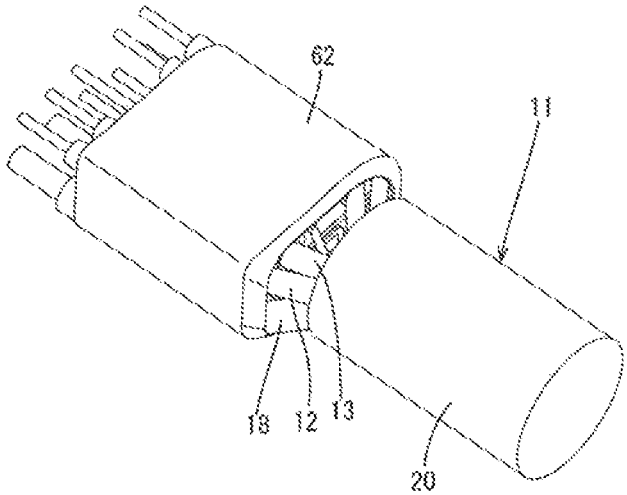
FIG. 14 is a perspective view showing a state where a tape is wound around wires mounted in the alignment members.
Figure 15:
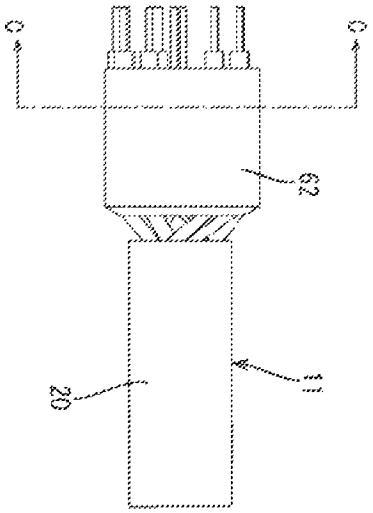
FIG. 15 is a plan view showing the state where the tape is wound around the wires mounted in the alignment members.
Figure 16:
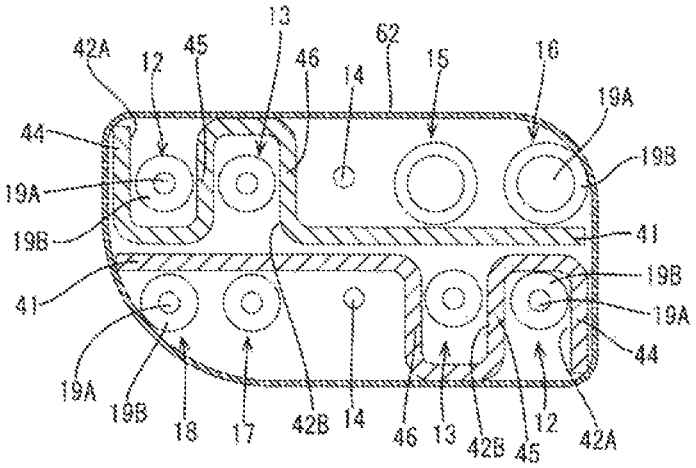
FIG. 16 is a section along C-C of FIG. 15.
Figure 17:
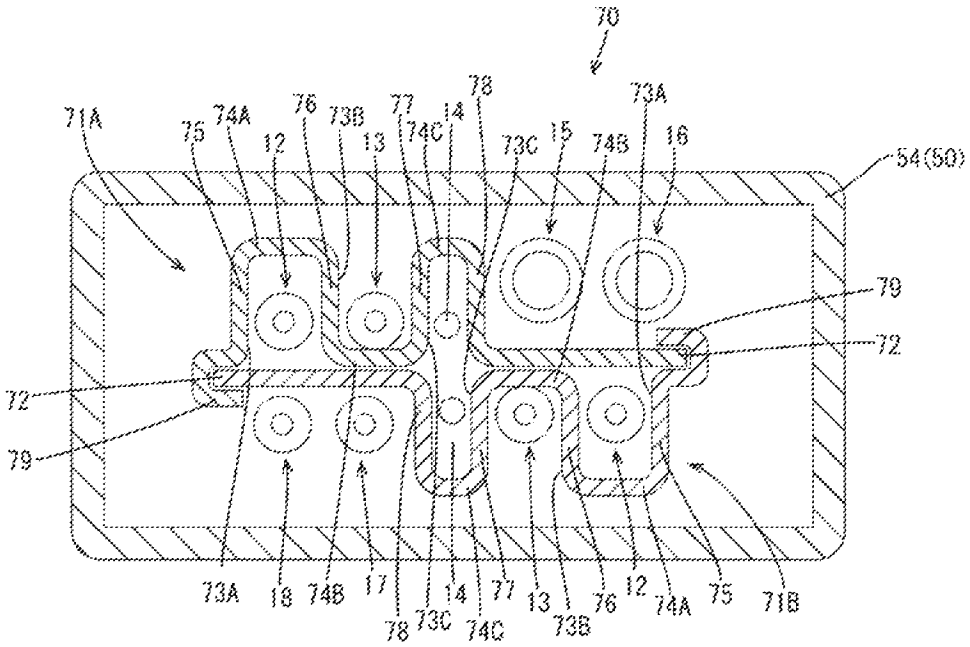
FIG. 17 is a section showing a communication connector with cable of a third embodiment.
Figure 18:
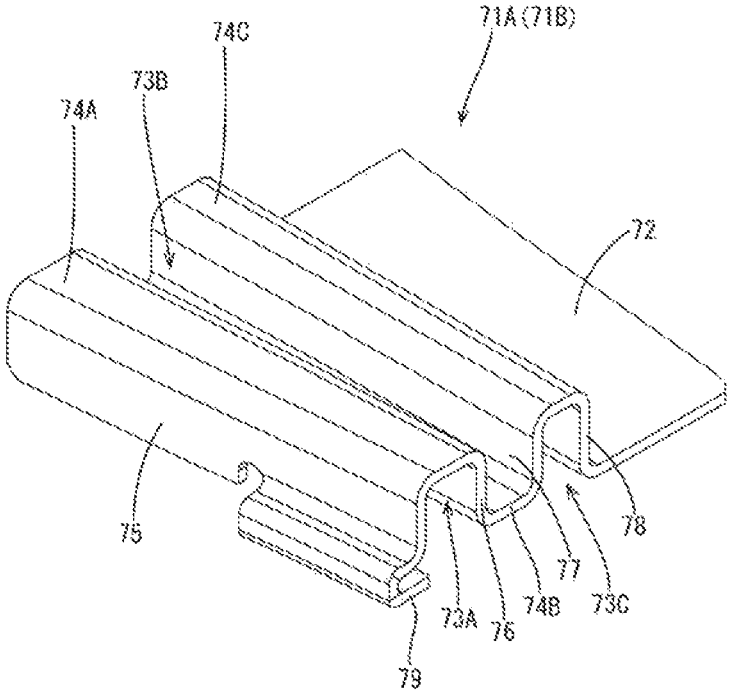
FIG. 18 is a perspective view showing an alignment member.
Figure 19:
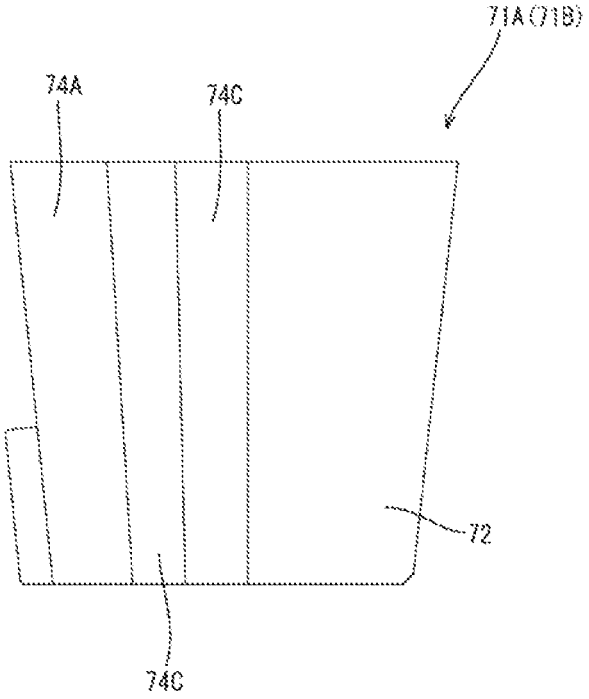
FIG. 19 is a plan view showing the alignment member.
Figure 20:
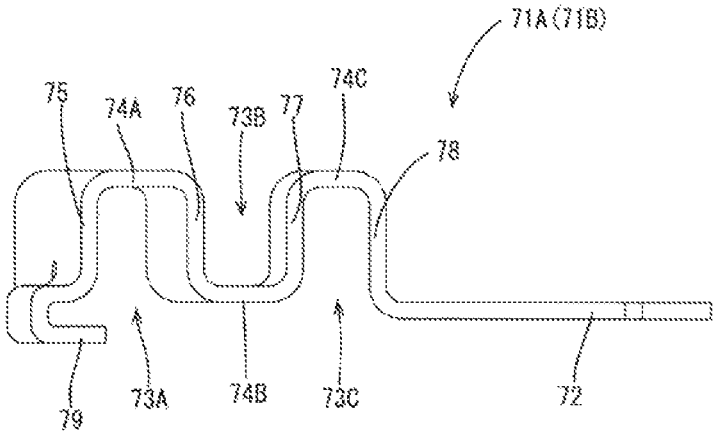
FIG. 20 is a back view showing the alignment member.

When the alignment members 40A, 40B are arranged to face each other in a back-to-back orientation, edges of the flat plates 41 are inserted between the groove bottoms 43 and the locking portions 48 and openings of the insertion groove portions 42B are covered with the flat plates 41, as shown in FIG. 11. Upper and lower wire rows at this time are arranged such that the wires 12, 13 are at positions orthogonal to each other (positions on distant sides). If the alignment members 40A, 40B are displaced in directions separating from each other, the locking portions 48 are locked to the flat plates 41 and relative movements between the alignment members 40A, 40B are restricted.

(Shield Case 50)

Figure 1:
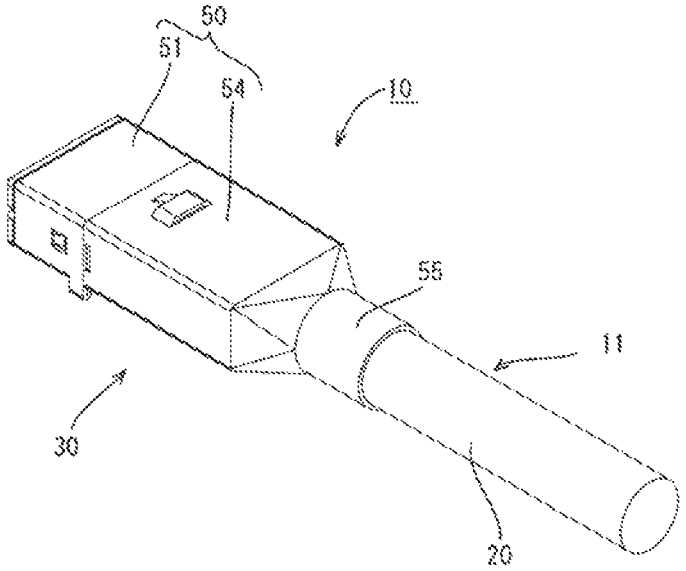
FIG. 1 is a perspective view showing a communication connector with cable of a first embodiment.

The shield case 50 is made of metal such as aluminum or aluminum alloy and includes, as shown in FIG. 1, a first shield case 51 for covering the body 36 of the housing 35 and a second shield case 54 for covering the wires 12 to 18 by being disposed behind the first shield case 51. The first shield case 51 is in the form of a rectangular tube and, as shown in FIG. 4, rearward extending plates 51A extending along side surfaces of the extending portion 38. Deflectable and deformable locking pieces 52 to be locked to the body 36 are provided on side surfaces of the first shield case 51 and are locked to the body. When the first shield case 51 is fit onto the housing 35 from behind the housing 35, but is stopped to move any further forward by a front end part of the housing 35, and the locking pieces 52 are locked into recesses in the side surfaces of the housing 35. Thus, the first shield case 51 and the housing 35 are positioned.

The second shield case 54 is in the form of a box with an open front and a rear end part includes a hollow cylindrical shield connecting portion 55 to be fit externally on the cable 11, as shown in FIG. 1. The shield connecting portion 55 is connected, for example, to the shielding layer folded onto the outer side of the coating 20 at the end part of the cable 11, such as by welding or crimping.

According to this embodiment, the metal partition walls 44 to 46 of the alignment members 40A, 40B are disposed between the wires 12 to 18 exposed by removing the coating 20 of the cable 11 in which the plurality of wires 12 to 18 for transmitting communication signals are surrounded collectively by the coating 20. Thus, impedance changes of the wires 12 to 18 can be suppressed in parts between the wires 12 to 18 where impedances easily change. Thus, the reflection of signals at impedance change points can be suppressed, and a reduction of communication quality can be suppressed.

If the terminals 31 are arranged side by side in one stage in the housing 35, the communication connector 30 becomes longer in an arrangement direction of the terminals 31. Thus, there is a problem that an arrangement space is more subject to restrictions in mounting the communication connector 30 in a limited space of the vehicle. On the other hand, the terminals 31 are arranged and held side by side in plural stages in the housing 35 according to this embodiment. Thus, the communication connector 30 has a compact shape and is less subject to arrangement space restrictions.

Further, the alignment members 40A, 40B are provided, and one alignment member 40A (40B) includes the locking portion 48 to be locked to the other alignment member 40B (40A). With this configuration, the locking portion 48 of the one alignment member 40A (40B) is locked to the other alignment member 40B (40A) so that relative positions of the alignment members 40A, 40B can be maintained. In this way, the wires 12 to 18 will not be lifted from the alignment members 40A, 40B due to relative displacements of the alignment members 40A, 40B.

The wires 12 to 18 include low-speed wires 17, 18 and high-speed wires 12, 13 capable of faster transmission than the low-speed wire, and the partition walls 44 to 46 partition the high-speed wires.

Signals are easily degraded by being reflected or radiated in wires for transmitting high-speed signals (e.g. 5 Gbps). However, according to this embodiment, degradation caused by the reflection or radiation of the signals can be suppressed.

Second Embodiment

A second embodiment is described with reference to FIGS. 12 to 16. In the second embodiment, alignment members 61A, 61B are not provided with the locking portions 48 of the first embodiment and the alignment members 61A, 61B and wires 12 to 18 are collectively wound with tape. In the following description, the same components as in the first embodiment are denoted by the same reference signs and not described.

A communication connector 60 includes terminals 31, a housing 35, alignment members 61A, 61B and a shield case 50. The alignment members 61A, 61B are formed by omitting the locking portions 48 from the alignment members 40A, 40B of the first embodiment.

A tape 62 is formed with a thin metal layer over the entire surface and an adhesive layer formed of an adhesive may be laminated on the metal layer. Further, a resin layer may be overlaid to enhance strength or an adhesive layer may be formed between the metal layer and a resin layer both having flexibility. A layer of aluminum, aluminum alloy or the like can be used as the metal layer.

According to the second embodiment, the tape 62 is wound around wires 12 to 18 with the wires 12 to 18 disposed on outer surface sides of the alignment members 61A, 61B. This configuration enables the wires 12 to 18 to be held in position by a simple configuration.

Further, the tape 62 is a metal tape including the metal layer. Thus, a reduction of communication quality can be suppressed by a shielding function of the metal tape.

Third Embodiment

A third embodiment is described with reference to FIGS. 17 to 20. In a communication connector 70 of the third embodiment, each alignment member 71A, 71B is provided with three insertion grooves 73A to 73C. In the following description, the same components as in the above embodiments are denoted by the same reference signs and not described.

The alignment members 71A, 71B have the same shape, are disposed to be connected behind an extending portion 38 and formed by stamping and bending a metal plate material, such as aluminum, aluminum alloy, copper or copper alloy. Each alignment member 71A, 71B includes a flat plate 72 extending in a lateral direction, the insertion grooves 73A to 73C into which wires 12 to 14 are inserted, and a locking portion 79 to be locked to the other alignment member 71A, 71B.

The insertion grooves 73A to 730 are disposed in opposite orientations via common partition walls 76, 77 and the wires 12 to 14 can be inserted from opposite vertical sides. Each insertion groove 73A to 73C includes groove bottoms 74A, 74B and partition walls 75 to 78 vertically standing from the groove bottoms 74A, 74B.

Widths of the flat plate 72 and the insertion groove portions 73A to 73C (width of the alignment member 71A, 71B) are reduced gradually toward a rear side. A locking portion 79 perpendicularly extending in a lateral direction and folded into a U shape is formed at an end part of the partition wall 78. The locking portion 79 is formed behind the partition wall 78.

The alignment members 71A, 71B are arranged to face each other in a back-to-back orientation so that edges of the flat plates 72 are inserted into clearances of the locking portions 79. If the alignment members 71A, 71B are going to move in separating directions, the locking portions 79 are locked to the flat plates 72 to restrict the separation of the alignment members 71A, 71B.

Fourth Embodiment

Figure 21:
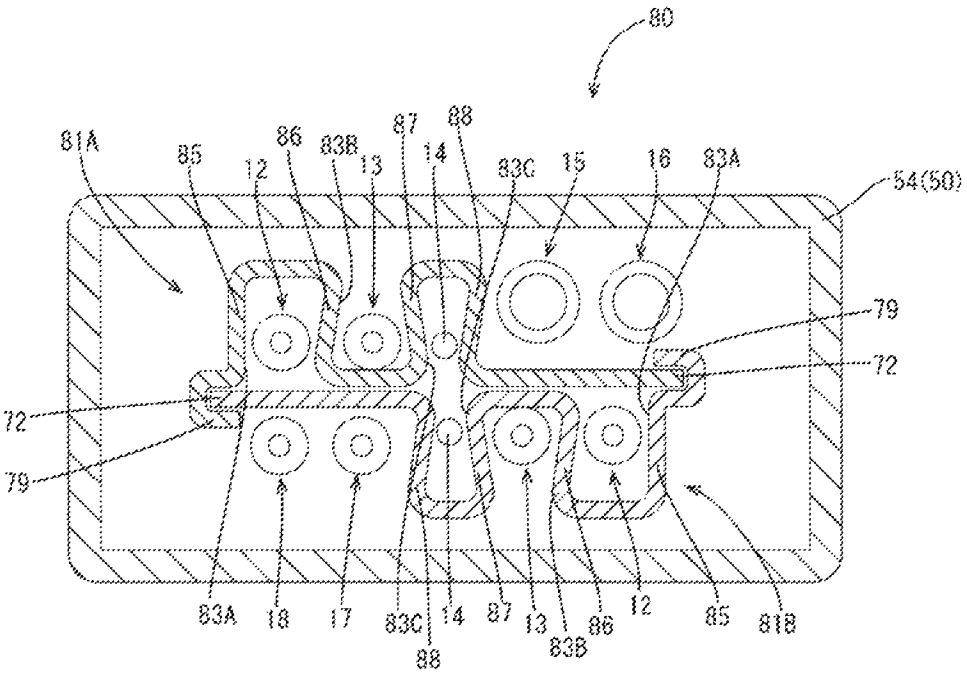
FIG. 21 is a section showing a communication connector with cable of a fourth embodiment.

A fourth embodiment is described with reference to FIG. 21. A communication connector 80 of the fourth embodiment has insertion grooves 83A to 83C in which partition walls 85 to 88 are inclined to narrow opening sides of the insertion grooves 73A to 73C of the third embodiment. The same components as in the above embodiments are denoted by the same reference signs and not described.

According to the fourth embodiment, since the openings of the insertion grooves 83A to 83C are small, wires 12 to 14 can be held in the insertion groove portions 83A to 83C.

The invention is not limited to the above described and illustrated embodiments. For example, the following embodiments also are included in the scope of the invention.

Figure 22:
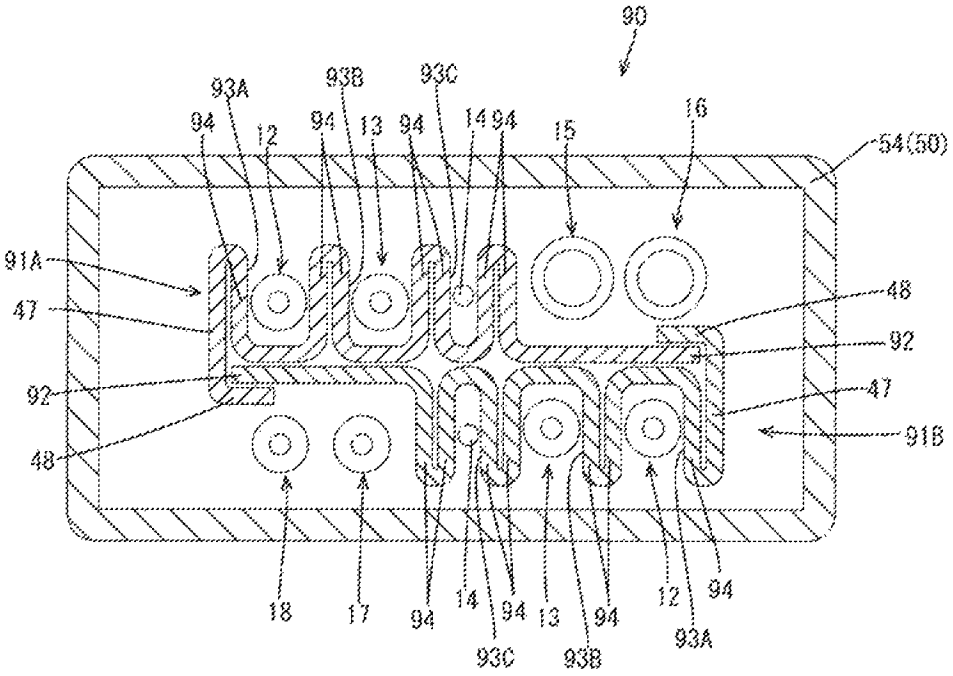
FIG. 22 is a section showing a communication connector with cable of another embodiment.
Figure 23:
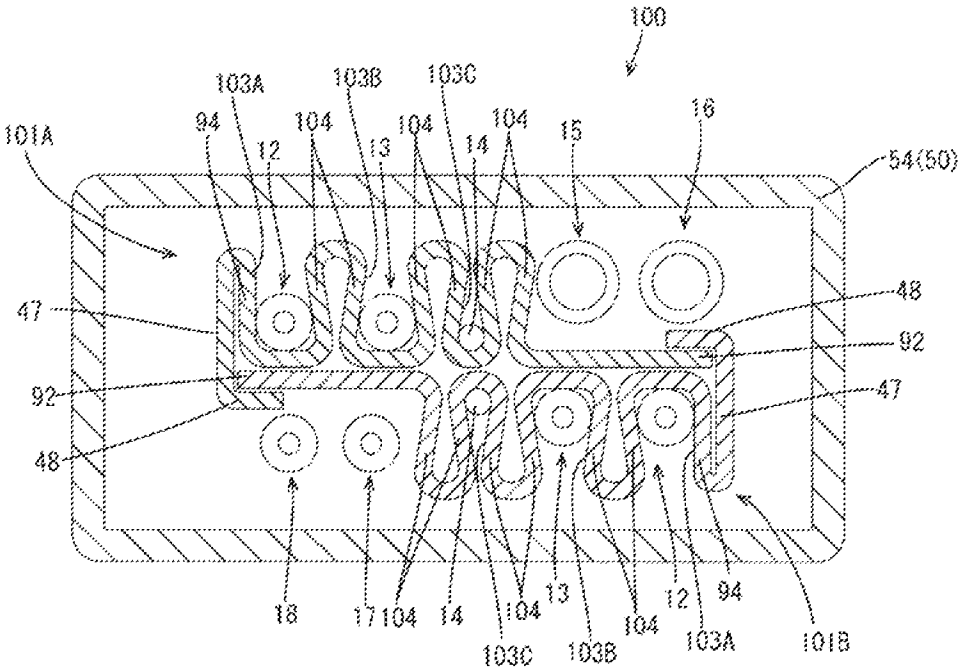
FIG. 23 is a section showing a communication connector with cable of another embodiment.

The shapes of the alignment members are not limited to those of the above embodiments and can be changed to various shapes. For example, as shown in FIG. 22, each of a pair of alignment members 91A, 91B of a communication connector 90 may be provided with three insertion grooves 93A to 930 open on an outer side and a flat plate 92, and partition walls 94 between adjacent wires 12 to 15 may be folded into a U shape to be doubled. Further, as shown in FIG. 23, each of a pair of alignment members 101A, 101B of a communication connector 100 may be provided with three insertion grooves 103A to 103C open on an outer side and a flat plate 92, and partition walls 104 folded into a U shape and doubled between adjacent wires 12 to 14 may be inclined to narrow opening sides of the insertion grooves 103A to 103C, thereby holding the wires 12 to 18 in the insertion grooves 103A to 103C.

Although two alignment members are provided, the communication connector may have one, three or more alignment members.

For the configuration in which the alignment members 40A, 40B are provided with the locking portions 48, the tape 62 may be wound around the alignment members 40A, 40B and the wires 12 to 18.

Although the wires 12, 13 in different wire rows are arranged at the diagonal positions, these wires may not be arranged at the diagonal positions.

The number of the wires 12 to 18 is not limited to the number shown above and may be a different number.

LIST OF REFERENCE SIGNS

10: communication connector with cable
11: cable
12 to 18: wire
20: coating
30, 60, 70, 80: communication connector
31: terminal
35: housing
40A, 40B, 61A, 61B, 71A, 71B, 81A, 81B, 91A, 91B, 101A, 101B: alignment member
42A, 42B, 73A to 73C, 83A to 83C, 93A to 93C, 101A to 103C: insertion groove
44 to 46, 76 to 78, 95 to 88, 94, 104: partition wall
48, 79: locking portion
50: shield case
62: tape

The invention claimed is:

1. A communication connector for a cable that has wires collectively surrounded by a coating, end regions of the wires being exposed by removing a portion of the coating, the communication connector comprising:

terminals to be connected respectively to the exposed regions of the wires;

a housing for holding the terminals side by side in each of first and second stages; and first and second alignment members disposed adjacent one another and configured for aligning the wires in the respective first and second stages, each of the alignment members being defined by a single metal plate that is formed to define two insertion grooves, each of the insertion grooves being configured to receive one of the wires, with the wires being insertable into the respective grooves in opposite directions, each of the insertion grooves including a groove bottom wall and a common partition wall partitioning the insertion grooves and extending between the groove bottom walls, the first alignment member includes a first locking portion to be locked to the second alignment member, and the second alignment member includes a second locking portion to be locked to the first alignment member.

2. A communication connector according to claim 1, wherein the wires include a low-speed wire and high-speed wires capable of faster transmission than the low-speed wire, and the common partition wall partitions between the pair of high-speed wires.

3. A communication connector with cable, comprising:

a communication connector according to claim 1; and the cable to be connected to the terminals.

4. A communication connector according to claim 1 wherein the first and second alignment members are configured identically to one another.

5. A communication connector according to claim 1 wherein each of the first and second alignment members includes a flat plate, a first of the insertion grooves in each of the first and second alignment members being adjacent the flat plate and a second of the insertion grooves in each of the first and second alignment members being on a side of the first insertion groove opposite the flat plate, the bottom wall of the second insertion groove in each of the first and second alignment members being substantially aligned with the flat plate, the bottom wall of the first insertion groove being offset from the flat plate.

6. A communication connector according to claim 1, wherein a tape is wound around the wires with each of the wires disposed on an outer surface side of one of the first and second alignment members.

7. A communication connector according to claim 6, wherein the tape is a metal tape including a metal layer.

8. A communication connector for a cable that has wires collectively surrounded by a coating, end regions of the wires being exposed by removing a portion of the coating, the communication connector comprising:

terminals to be connected respectively to the exposed regions of the wires;

a housing for holding the terminals side by side in each of first and second stages; and first and second alignment members disposed adjacent one another and configured for aligning the wires in the respective first and second stages, each of the alignment members being defined by a single metal plate that is formed to define two insertion grooves, each of the insertion grooves being configured to receive one of the wires, with the wires being insertable into respective grooves in opposite directions, each of the insertion grooves including a groove bottom wall and a common partition wall partitioning the insertion grooves and extending between the groove bottom walls, each of the first and second alignment members includes a flat plate, a first of the insertion grooves in each of the frst and second alignment members being adjacent the flat plate and a second of the insertion grooves in each of the first and second alignment members being on a side of the first insertion groove opposite the flat plate, the bottom wall of the second insertion groove in each of the first and second alignment members being substantially aligned with the flat plate, the bottom wall of the first insertion groove being offset from the flat plate, wherein the second insertion groove of each of the alignment members includes a side wall opposed to the common partition wall, a lock extending from the side wall of the second insertion groove and being engaged with the flat plate of the other of the alignment members.

9. A communication connector according to claim 8, wherein the flat plate of the first alignment member closes the first insertion groove of the second alignment member, and the flat plate of the second alignment member closes the first insertion groove of the first alignment member.

* * * * *